United States Patent [19]

Chi

[11] 4,358,043

[45] Nov. 9, 1982

[54] SPRING-ENERGIZED STAPLING MACHINE

[76] Inventor: Hui-Neng Chi, 17, 119 La., Tate St., Taichung City, Taiwan

[21] Appl. No.: 135,204

[22] Filed: Mar. 28, 1980

[30] Foreign Application Priority Data

Dec. 21, 1979 [TW] Taiwan ..... 6825081

[51] Int. Cl.[3] ..... B25C 5/02

[52] U.S. Cl. ..... 227/155; 227/132

[58] Field of Search ..... 227/109, 110, 132, 154, 227/155, 156

[56] References Cited

U.S. PATENT DOCUMENTS 3,347,439 10/1967 Doherty ..... 227/109

4,025,031 5/1977 Chi ..... 227/132

4,051,991 10/1977 Goodchild ..... 227/155

4,227,638 10/1980 Medina et al. ..... 227/155

*Primary Examiner*—Paul A. Bell

[57] ABSTRACT

An improved spring-energized stapling machine comprises a body, an actuating arm which is secured to the body to pivot about a pin, a movable fitting and a driving pin extending through an end portion of a tongue on the arcuate arm and through arcuate slots in the body. When the actuating arm is in its original position, the driving pin will be at the lower end of the arcuate slots and contacts the fitting so as to move the fitting away from a base of the body.

2 Claims, 3 Drawing Figures

SPRING-ENERGIZED STAPLING MACHINE

BACKGROUND OF THE INVENTION

This invention relates to an improved device for driving a movable fitting mounted on a spring-energized stapling machine after a staple has been ejected out of the spring-energized stapling machine. It is an improvement of my prior application, filed on Jan. 29, 1976, for "Stapling Machine" issued as U.S. Pat. No. 4,025,031.

SUMMARY OF THE INVENTION

According to the present invention, an improved spring-energized stapling machine comprises a body having a base; an actuating arm pivotally mounted on the body; spring means for ejecting staples from the machine upon operation of the actuating arm; a check plate slidably mounted on the body and selectively movable into a position to immobilize the actuating arm, the check plate being mounted on the body by means of a pin extending through the body and through slots in the check plate; a movable fitting having a base panel with recesses therein and side walls, each side wall having an inverted substantially U-shaped slot therein cooperating with a pair of pins on the body so as to permit the fitting to be slidable between a first position at which the fitting is spaced from the base of the body to enable the recesses in the base panel to clinch staples ejected from the machine, a second position at which the fitting abuts against the base of the body to block the ejection of staples from the machine and a third position at which the base panel is angularly displaced through substantially 90° to allow staples to be ejected without clinching from the machine; and a slidable driving pin extended through an end portion of a tongue of the actuating arm and through a pair of opposed arcuate slots provided in the body and driven by operation of the actuating arm to move it in the arcuate slots, wherein after ejection of a staple from the machine, ends of the driving pin are driven to the lower end of the arcuate slots to contact the upper edge of the side walls of the movable fitting so as to move the base panel of the fitting a desired distance away from the base of the body, when the fitting is in the first position.

When the movable fitting is in the first position, according to the present invention, the base panel of the fitting will be caused to move away from the base of the body by displacement of the driving pin in the arcuate slots of the body after each ejection of a staple from the machine. This provides advantages for the user by allowing removal of the fastened sheets of paper easily without moving the fitting away from the base of the body by hand and without causing any damage to the paper.

DESCRIPTION OF THE DRAWING

The invention will be described further, by way of example, with reference to the accompanying drawings, in which;-

DETAILED DESCRIPTION OF THE PREFERRED EMBODIMENT

Figure 1:
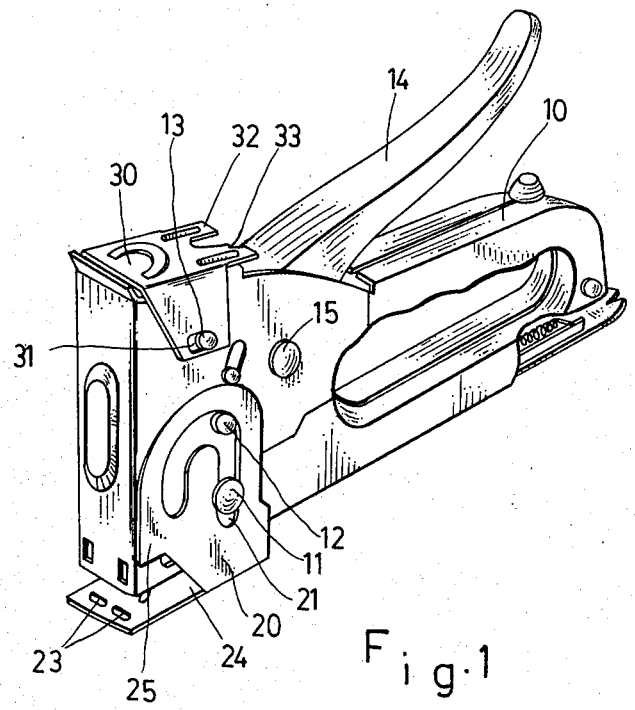
FIG. 1 is a perspective view of an improved spring-energized stapling machine according to the present invention.

Referring to FIG. 1, an improved spring-energized stapling machine comprises a body 10 and an actuating arm 14 which is secured to the body 10 for pivotal movement about a pin 15. A pin 13 forms a mounting for a check plate 30, the check plate 30 being movable back and forth for locking and unlocking the actuating arm 14. Two further pins 11 and 12 provide a mounting for a movable fitting 20. The movable fitting 20 comprises a base panel 24 and two side walls 25, each side wall having an inverted U-shaped slot 21 therein (only one side wall is shown in FIG. 1). A protuberance (not shown) is provided on one of the side walls to provide a means for locking the fitting 20 in desired positions by engaging corresponding recesses in the body 10. The movable fitting 20 is mounted on the body 10 of the stapling machine such that the pins 11 and 12 engage in the slots 21 in the side walls 25. The fitting 20 can be moved by sliding about the pins 11 and 12. Two recesses 23 formed in the base panel 24 serve to clinch the ends of staples when the stapling machine is used to fasten together loose sheets of paper. The check plate 30 includes two projections 32, one check tip 33 and a pair of corresponding slots 31 formed in the two walls thereof. The check plate 30, when mounted on the body 10 with the pin 13 passing through the slots 31, forms a releasable lock means for the actuating arm 14. When the stapling machine is not in operation, the check plate 30 is moved towards the actuating arm 14 whereby the check tip 33 contacts the front end of an extension (not shown) on the arm 14 to immobilize the arm 14.

To eject staples, the actuating arm 14 is depressed to pivot about the pin 15 against the action of a spring device (not shown) which is used to eject staples from the machine. This spring device is known to those skilled in the art and need not be described in greater detail hereinafter.

It should be understood that all of the described-above constructions of the stapling machine have been disclosed in the U.S. Pat. No. 4,025,031 and are not unique characteristics of the present invention.

Figure 2:
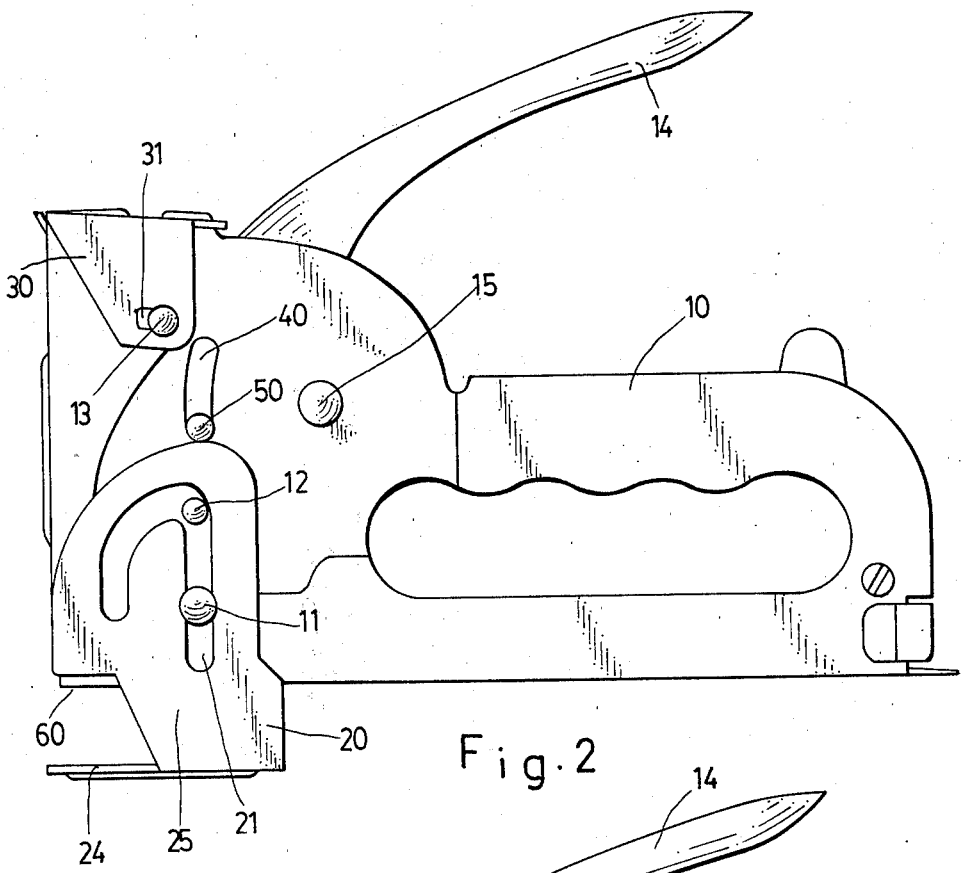
FIG. 2 is a side view of the improved spring-energized stapling machine as shown in FIG. 1.
Figure 3:
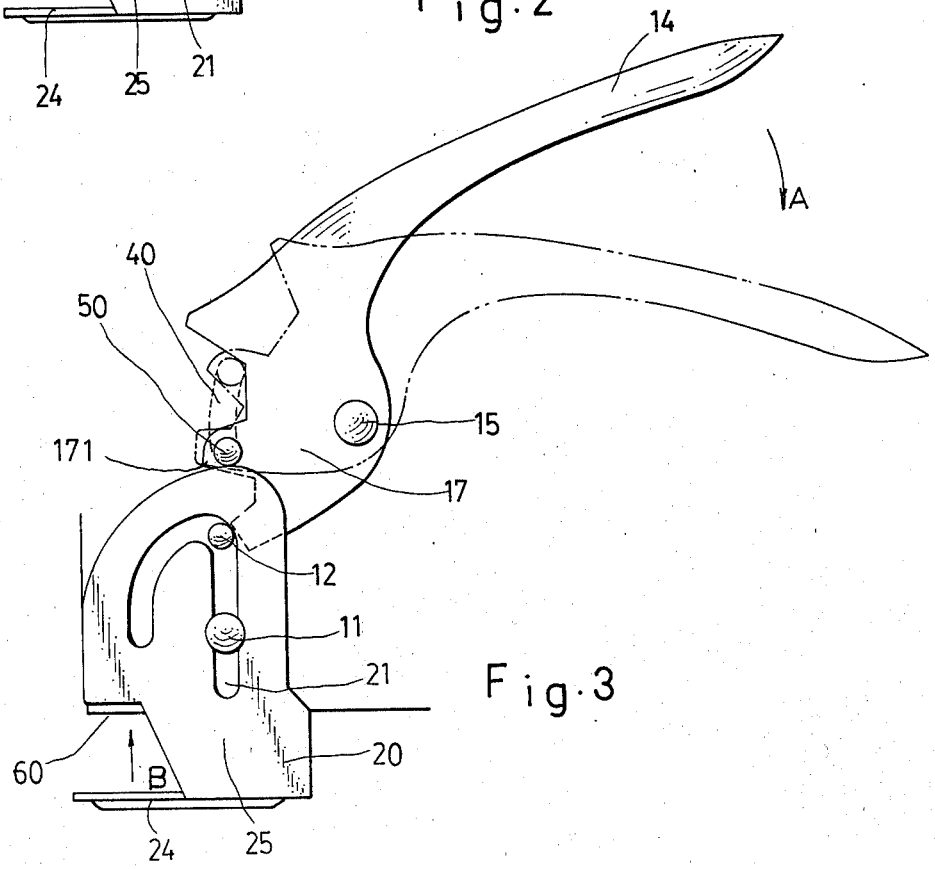
FIG. 3 is an explanatory schematic representation illustrating the effect of the operation of the actuating arm.

Referring now to FIGS. 2 and 3, as described above, a pair of opposed arcuate slots 40 are provided in the side walls of the body 10 and between the lower edge of the check plate 30 and the upper edge of the fitting 20. Extending through an end portion 171 of a tongue 17 on the actuating arm 14 is a driving pin 50. The ends of the driving pin 50 extend through and protrude out respective ones of the arcuate slots 40, so that the driving pin 50 can be moved in the arcuate slots 40 by operation of the actuating arm 14. In other words, ends of the driving pin 50 are positioned at the lower end of the arcuate slots 40 and contact the upper edge of the fitting 20 if the fitting 20 is in the first position and when the actuating arm 14 is in its initial position as shown in solid line in FIG. 3. On the other hand, the driving pin 50 is moved upwards to the upper portion of the arcuate slots 40 when the actuating arm 14 is moved downwards, as shown in dotted line in FIG. 3, for ejecting a staple from the machine.

Consequently, if one wants to fasten together loose sheets of paper, he may position the movable fitting 20 in the first position as shown in FIG. 2, then, put the loose sheets of paper into a space between the base 60 of the body 10 and the base panel 24 of the fitting 20 and turn one end of the actuating arm 14, in an arrow 'A' direction, to make it move downwardly so as to move the driving pin 50 to the upper portion of the arcuate slots 40. This permits the base panel 24 of the fitting 20 to move upwardly, along an arrow 'B' direction, to clamp the loose sheets of paper for ejecting the staple accurately into the sheets of paper. After a staple is ejected into the paper in the machine, the actuating arm 14 is returned to its initial position by the spring device (not shown), the driving pin 50 being driven accordingly to the lower end of the arcuate slots 40 and contact the upper edge of the fitting 20 thereby moving the base panel 24 of the fitting 20 away from the base 60 of the body 10 so that the user can easily remove the fastened sheets of paper without causing any damage to the paper.

It should be understood that they traveling distance of the driving pin 50 in the arcuate slots 40 is preferably equal to or slightly larger than the maximum permissible movement of the fitting 20 in the longitudinal direction, when the fitting is in its first position.

It should also be understood that when driving staples into other objects, the movable fitting 20, by virtue of the slots 21 and the pins 11 and 12, may be turned through substantially 90° into a position at which the base panel 24 is perpendicular to the base 60 and disposed against the front face of the machine. Under this circumstance, the protruding ends of the driving pin 50 do not press against the fitting 20 although they are positioned at the lower end of the arcuate slots 40.

What is claimed is:

1. An improved spring-energized stapling machine comprises a body having a base; an actuating arm pivotally mounted on the body; spring means for ejecting staples from the machine upon operation of the actuating arm; a check plate slidably mounted on the body and selectively movable into a position to immobilize the actuating arm, the check plate being mounted on the body by means of a pin extending through the body and through slots in the check plate; a movable fitting having a base panel with recesses therein and two side walls, each side wall having an inverted substantially U-shaped slot therein cooperative with a pair of pins on the body so as to permit the fitting being slidable between a first position at which the fitting is spaced from the base of the body to enable the recesses in the base panel to clinch staples ejected from the machine, a second position at which the fitting abuts against the base of the body to block the ejection of staples from the machine and a third position at which the base panel is angularly displaced through substantially 90° to allow staples to be ejected without clinching from the machine; and a slidable driving pin extended through an end portion of a tongue of the actuating arm and through a pair of opposed arcuate slots provided in the body and driven by operation of the actuating arm to move it in the arcuate slots, wherein after ejection of a staple from the machine upon upward movement of the actuating arm, ends of the driving pin are driven to the lower end of the arcuate slots to contact against upper edge of the side walls of the movable fitting respectively so as to move the base panel of the fitting a desired distance away from the base of the body.

2. An improved spring-energized stapling machine as claimed in claim 1 wherein the traveling distance of the driving pin is at least equal to the maximum permissible movement of the fitting in the direction perpendicular to the base, when the fitting is in the first position.

* * * * *